US005730055A

United States Patent [19]

Döpke et al.

[11] Patent Number: 5,730,055

[45] Date of Patent: Mar. 24, 1998

[54] SHEET GUIDING DEVICE FOR PRINTING PRESSES

[75] Inventors: Stefan Döpke, Rehburg-Loccum; Katrin Ewert, Jügesheim-Rodgau, both of Germany

[73] Assignee: Heidelberger Druckmaschinen AG, Heidelberg, Germany

[21] Appl. No.: 798,514

[22] Filed: Feb. 10, 1997

[30] Foreign Application Priority Data

Feb. 8, 1996 [DE] Germany ..... 196 04 562.2

[51] Int. Cl.[6] ..... B41F 5/02

[52] U.S. Cl. ..... 101/230; 271/189; 271/209

[58] Field of Search ..... 101/232, 230, 101/231, 177, 409; 271/82, 182, 183, 188, 189, 191, 193, 902, 209

[56] References Cited

U.S. PATENT DOCUMENTS

| | | | |
|---|---|---|---|
| 4,253,759 | 3/1981 | Rattin | 271/171 |
| 4,404,905 | 9/1983 | Simeth et al. | 101/183 |
| 4,621,576 | 11/1986 | Wirz | 101/230 |
| 4,645,195 | 2/1987 | Scranton et al. | 101/230 |
| 5,036,763 | 8/1991 | Germann et al. | 101/177 |
| 5,335,083 | 8/1994 | Kuo et al. | 271/188 |
| 5,431,386 | 7/1995 | Blaser | 271/277 |
| 5,549,291 | 8/1996 | Devito | 271/182 |
| 5,609,103 | 3/1997 | Stephan et al. | 101/230 |
| 5,633,449 | 5/1997 | Henn et al. | 101/232 |
| 5,667,122 | 9/1997 | Young, Jr. et al. | 226/20 |
| 5,668,919 | 9/1997 | Detmers et al. | 271/183 |

FOREIGN PATENT DOCUMENTS

| | | |
|---|---|---|
| 225 409 A1 | 6/1984 | Germany . |
| 44 27 897 C1 | 9/1995 | Germany . |

*Primary Examiner*—Eugene H. Eickholt

*Attorney, Agent, or Firm*—Herbert L. Lerner; Laurence A. Greenberg

[57] ABSTRACT

A sheet guiding device for printing presses, wherein, for recto printing, a sheet decurler is pivotable into a gap formed in a guide surface and, for recto/verso printing, the sheet decurler is pivotable out of the gap, a surface element of the guide surface being displaceable for closing the gap wherein the sheet decurler is engageable, includes a drive lever which, for switching to recto printing, is operatable for displacing the surface element in order to form the gap and for engaging the sheet decurler and pivoting it into the gap, the drive lever, for switching to recto/verso printing, being operatable for releasing the sheet decurler to swivel out of the gap and for engaging and displacing the surface element.

13 Claims, 8 Drawing Sheets

SHEET GUIDING DEVICE FOR PRINTING PRESSES

BACKGROUND OF THE INVENTION:

Field of the Invention

The invention relates to a sheet guiding device for printing presses which, for recto or one-sided printing, swivels a sheet decurler into the gap of a guide surface and, for recto/verso or two-sided printing, swivels the sheet decurler outwardly, the gap for engagement by the sheet decurler being closed by the displacement of a surface element of the guide surface.

In printing presses, various demands have been made upon sheet guidance, depending upon whether recto, i.e., one-sided, printing is involved or recto/verso, i.e., two-sided, printing is involved. In one-sided printing, only one side of the sheet is printed during one pass of the press, and as a consequence thereof, the sheet tends to curl. It is therefore necessary, after such a pass of the press, to provide a sheet decurler in the press, which eliminates this type of curling of the sheet before the delivery pile is formed.

Because the sheets are printed on both sides thereof during one pass of the press, there is no such tendency to curling. Instead, it is necessary, however, that the sheets printed on both sides thereof be transported to the delivery pile without smearing, or in other words on a cushion of air. Transporting the sheets in this manner is performed with a guide surface which may be provided with air nozzles. This guide surface must have no interruption because, at such interruptions, the danger of smearing of the sheets is considerably increased.

To solve this problem, the published German Patent Document DE 44 27 897 C1 has proposed providing a sheet decurler located below the guide surface and disposed in a stationary manner on the frame of the printing press; to close the guide surface during two-sided printing, the sheet decurler is covered by a plate. In this manner, although the sheet decurler, for one-sided printing, is available with a simple mechanism, and a closed guide surface is available for two-sided printing, a disadvantage exists in that the sheet decurler must be located below the guide surface, and the sheets are therefore poorly aspirated through the sheet decurler for them to uncurl. The sheet decurler cannot therefore be positioned optimally, in this manner.

In contrast therewith, the published East German Patent Document DD 225 409 A1 proposes, for a sheet guiding device of the type referred to in the introduction hereto, to provide a sheet decurler which is swivellable out of the working position by a lever, counter to the force of a compression spring. This swivelling is attained by a rocker with a cam which simultaneously moves the guide element in a guide. The sheet decurler is swivelled into a gap formed by the movement of the guide element.

The latter, heretofore known device, however, has a complicated and expensive mechanism because the sheet decurler is supported on the lever which is equipped with the roller and the spring. Acting upon the roller, in turn, is the cam via the driven rocker, which simultaneously moves the guide element via a coupler. Such a complex mechanism is not only complicated but also vulnerable to malfunction, requires a large amount of space, and needs a relatively strong driving force.

SUMMARY OF THE INVENTION

It is therefore an object of the invention to provide a sheet guiding device of the general type referred to at the introduction hereto which is of relatively simple construction, functions well, and requires relatively little installation space.

With the foregoing and other objects in view, there is provided, in accordance with the invention, a sheet guiding device for printing presses, wherein, for recto printing, a sheet decurler is pivotable into a gap formed in a guide surface and, for recto/verso printing, the sheet decurler is pivotable out of the gap, a surface element of the guide surface being displaceable for closing the gap wherein the sheet decurler is engageable, comprising a drive lever which, for switching to recto printing, is operatable for displacing the surface element in order to form the gap and for engaging the sheet decurler and pivoting it into the gap, the drive lever, for switching to recto/verso printing, being operatable for releasing the sheet decurler to swivel out of the gap and for engaging and displacing the surface element.

In accordance with another feature of the invention, the drive lever is a two-armed rotary lever having a first arm for releasing and pivoting the sheet decurler into the gap, and a second arm for displacing the surface element.

In accordance with a further feature of the invention, the displaceable surface element is disposed downstream of the gap, as viewed in the sheet travel direction.

In accordance with an added feature of the invention, the sheet guiding device includes a flexible sheet guiding element for extending the guiding surface which is disposed between an end of the surface element and a delivery pile, the flexible sheet guide element being secured at one end thereof and, at the other end thereof, being shortenable and elongatable by deflection and force application in accordance with the displacement of the surface element.

In accordance with an additional feature of the invention, the surface element, at the end thereof viewed in the sheet travel direction, has a rod disposed crosswise to the sheet travel direction, a flexible sheet guiding element being guidable over the rod, the flexible sheet guiding element being acted upon in the vicinity of the rod by a force directed away from the sheet travel direction, and being retained at the other end thereof so that the sheet guiding element adjoins the surface element and extends the guide surface.

In accordance with yet another feature of the invention, the flexible sheet guiding element is a closed web.

In accordance with an alternative feature of the invention, the flexible sheet guiding element is formed of a plurality of cords.

In accordance with yet a further feature of the invention, the sheet guiding device includes a guide for supporting the surface element.

In accordance with yet an added feature of the invention, the sheet guiding device includes pivotable levers for supporting the surface element.

In accordance with yet an additional feature of the invention, the pivotable levers are disposed so that the position of the surface element relative to the sheet travel path is the same in both recto printing and recto/verso printing.

In accordance with another feature of the invention, the sheet travel path has a change of direction at a given location thereof, and the surface element is connected rotationally movably to a further displaceable surface element following the sheet travel path after the change of direction thereof, the rotationally movable connection being disposed at the location of the change of direction.

In accordance with a further feature of the invention, the rotationally movable connection has a curved intermediate piece connected rotationally movably both to the surface element and to the further displaceable surface element.

In accordance with a concomitant feature of the invention, the surface element is connected to the further displaceable surface element by a flexible connecting piece, the flexible connecting piece being disposed at the location of the change of direction.

The embodiment according to the invention requires only a few moving parts, which results in the relatively simple construction and good functioning thereof. Moreover, lower driving forces are needed, because little friction occurs and no spring force has to be overcome. As a result, a switchover or conversion can be performed relatively easily by hand or with a relatively low mechanical adjusting force.

One embodiment of the invention provides for the drive lever to be a two-armed rotary lever having a first arm which serves to release and pivot the sheet decurler inwardly into the gap, and a second arm serving to displace the surface element. As a result, the actuation of the sheet decurler and the displacement of the surface element occur virtually successively, so that only one of the actuating forces at a time has to be brought to bear. Consequently, the driving force can be reduced considerably compared with that of the prior art referred to at the introduction hereto, in which the sheet decurler and the guide element are connected to one another via the gear mechanism and must be actuated simultaneously.

It is expediently provided for the displaceable surface element to be disposed downstream from the openable and closable gap, as viewed in the sheet travel direction. This embodiment is advantageous because this portion of the guide surface has no curvature, as is the case in the region upstream therefrom and, consequently, the spacing between the guide surface and the sheet travel path remains unchanged by the displacement.

An advantageous further feature provides that, between the end of the surface element, i.e., the displaceable surface element or the further displaceable surface element, and the delivery pile, a flexible sheet guiding element is disposed. It serves to extend the guide surface and is secured at one end thereof, and can be shortened and lengthened at the other end thereof, depending upon the displacement or motion of the surface element, by means of a deflection and an imposition of force. The flexible sheet guiding element may be constructed so that it is rolled up by spring force like a window shade, or it is possible that at the end thereof, as viewed in the sheet travel direction, the surface element has a rod disposed crosswise to the sheet travel direction, over which the sheet guiding element is guided. This sheet guiding element is acted upon in the vicinity of the rod by a force directed away from the sheet travel direction, and at the other end thereof is retained in a manner that the sheet guiding element which adjoins the surface element extends the guide surface. Naturally, the rod may also be located in the vicinity of the delivery pile, and may be fastened to the surface element. In this way, a closed guide surface is assured despite the adjustment of the surface element, and this guide surface has no gap from the last sheet-guiding cylinder or drum all the way to the delivery pile. This is especially important because, in recto/verso or two-sided printing, the danger exists that smearing can occur at such gaps, because the air cushion is not assured at those locations.

The sheet guide element may be constructed as a flexible closed web, and may, for example, be formed as a foil. However, it is also possible that the sheet guide element may be formed of a plurality of cords which, in this region, already guide sheets which have undergone drying for a given period of time.

The surface element may be supported by a guide; however, it may also be supported on pivotable levers. The latter option offers a very simple solution which can therefore be produced economically. Another advantageous construction provides for the position of the surface element relative to the sheet travel path to be the same both in recto or one-sided printing and in recto/verso or two-sided printing, which can, for example, be achieved by disposing the pivotable levers accordingly.

For a delivery system which has a change of direction of the sheet travel path, a further construction may be provided. Such a change of direction may, for example, be that the sheet travel path first leads upwardly away from the printing press and then proceeds horizontally to end above a relatively high delivery pile. This construction contemplates that the surface element be connected rotationally movably to a further displaceable surface element which follows the sheet travel path after a change of direction, the rotationally movable connection being disposed at the location of the change of direction. The aforementioned flexible sheet guiding element can adjoin this further displaceable surface element, as well. Consequently, in such a delivery system, a closed guide surface extending from the last sheet-guiding cylinder or drum as far as the delivery pile is assured.

In order to ensure a constant spacing between the guide surface and the sheet travel path in every setting upon the displacement of the surface element and the further displaceable surface element, the rotationally movable connection may include a curved intermediate piece which is connected rotationally movably both to the surface element and the further surface element. Another option for attaining a constant spacing between the guide surface and the sheet travel path in every setting may reside in that the surface element be connected to the further displaceable surface element by a flexible connecting piece which is disposed at the location of the change of direction. In that event, the rotationally movable connections can be dispensed with, and no edge whatever in the guide surface is created when an adjustment is performed.

Other features which are considered as characteristic for the invention are set forth in the appended claims.

Although the invention is illustrated and described herein as embodied in a sheet guiding device for printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
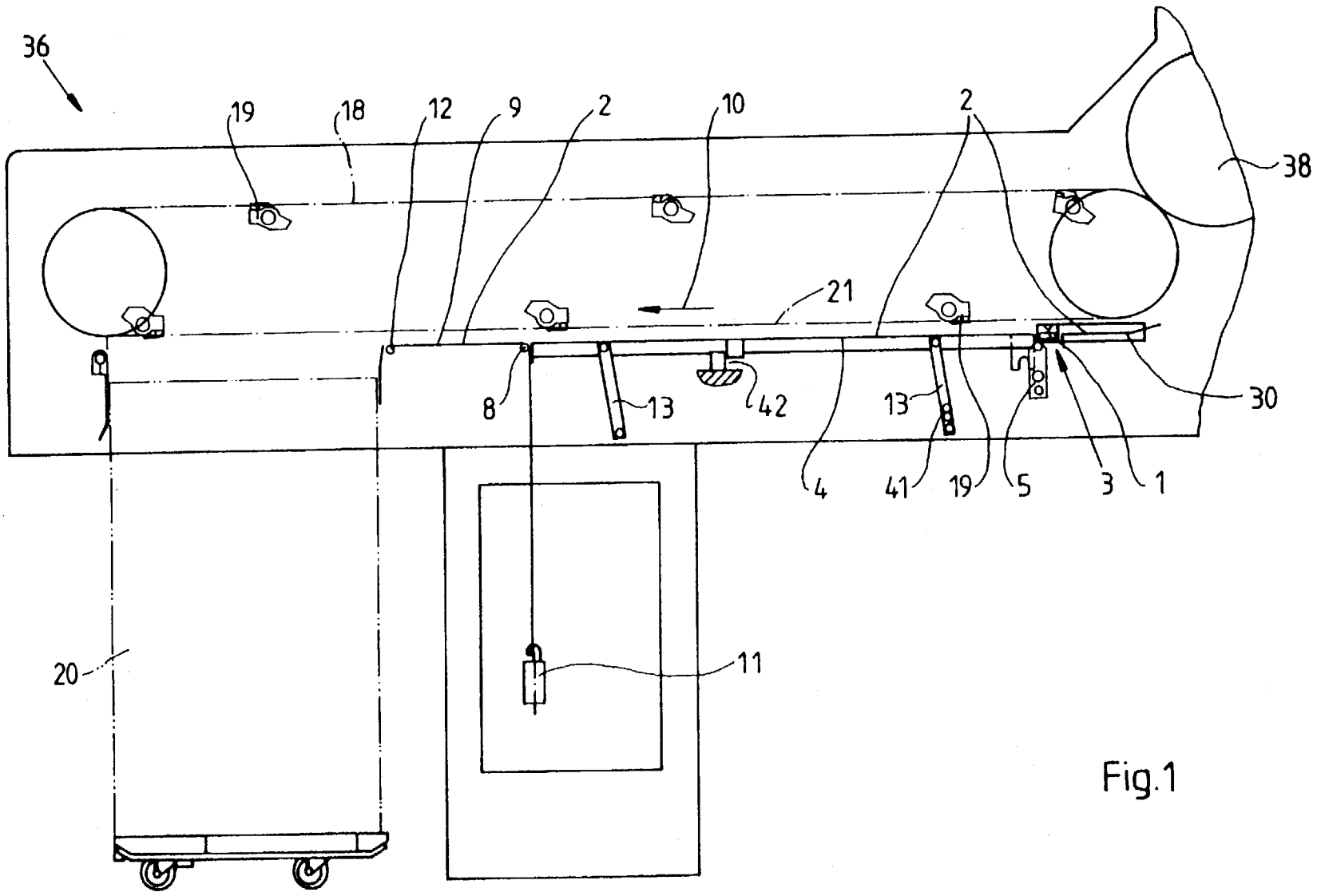
FIG. 1 is a diagrammatic side elevational view of a first exemplary embodiment of the sheet guiding device according to the invention.

Referring now to the drawings and, first, particularly to FIG. 1 thereof, there is shown therein a first exemplary embodiment of the sheet guiding device according to the invention. This sheet guiding device is built into a delivery system 36 of a printing press. The delivery system 36 takes the sheet over from a sheet-guiding cylinder or drum 38, feeds it in a sheet travel direction represented by the arrow 10 to a delivery pile 20 and deposits it thereat. Along this feed route, satisfactory sheet travel must be attained, the various demands referred to at the introduction hereto for recto or one-sided printing and for recto/verso or two-sided printing having to be taken into account in this process. It is therefore provided that the guide surface 2 for recto/verso or two-sided printing be a closed guide surface 2 and that, for recto or one-sided printing, a gap 3 be opened into which a sheet decurler 1 can be driven. FIG. 1 shows the first exemplary embodiment in the one-sided printing position, the gap 3 having been formed in that a displaceable surface element 4 is supported on pivotable levers 13 and has been displaced in the direction of sheet travel 10. In order that the guide surface 2 be closed as far as the delivery pile 20, the displaceable surface element 4 is connected, at the end thereof as viewed in the sheet travel direction 10, to a rod 8 which immediately adjoins the displaceable surface element 4. A flexible sheet guiding element 9 extends at one end thereof over this rod 8 and is secured at the other end 12 thereof, in this way extending the guide surface 2 as far as the delivery pile 20. A force 11, such as a weight, for example, assures that the flexible sheet guiding element 9 is always kept taut and passes over the rod 8 in such a way that, depending upon the displacement of the surface element 4, it becomes longer or shorter with respect to the guide surface portion thereof at the guide surface 2.

Because the flexible sheet guide element 9 exerts a reaction force on the surface element 4, a stop 42 is provided which stops the surface element 4 at the correct position. In the two-sided printing position, this force is brought to bear by a bracket or cantilever 25 and a drive lever 5 as well as a detent 35 (note FIG. 4), as is described hereinafter in further detail.

The function or operation is as follows: Gripper systems 19, which are pivotably connected to revolving chains 18 of the delivery system 36, take a sheet from the last sheet-carrying cylinder or drum 38, guide it first over an initially curved stationary guide surface portion 30, and then over the inwardly pivoted sheet decurler 1 which, by aspiration in a conventional manner, counteracts the tendency of the sheet to curl. Thereafter, via the chains 18, the gripper systems 19 feed the sheet along the guide surface 2 via the displaceable surface element 4 and the flexible sheet guiding element 9 and surrender it to the delivery pile 20.

Figure 2:
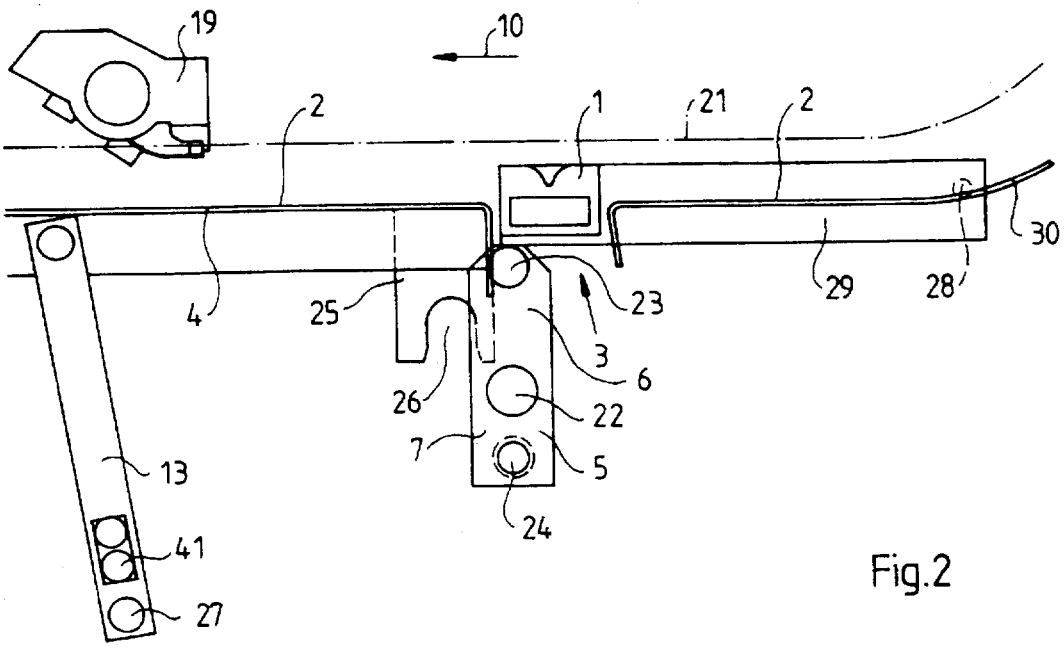
FIG. 2 is an enlarged fragmentary view of FIG. 1, showing the first exemplary embodiment of the device according to the invention in a recto or one-sided printing position.

FIG. 2 shows an enlarged detail of FIG. 1 in the one-sided printing position. The sheet decurler 1 is secured to a pivot lever 29, supported by a pivot shaft 28, and is pivoted inwardly into the gap 3 between the stationary guide surface portion 30 and the surface element 4. The gap 3 required for the inward pivoting is formed by the displacement of the displaceable surface element 4 in the sheet travel direction 10 a distance corresponding to the width or size of the gap 3. This is accomplished by pivotable levers 13 supported on pivot shafts 27, preferably two sets of such pivotable levers 13, respectively, forming one pair on the drive side and one pair on the control side of the printing press below the displaceable surface element 4, as can be seen from FIG. 1. In the position shown in FIG. 2, the sheet decurler 1 is retained by a roller 23, which is supported on a drive lever 5. This drive lever 5 is a two-armed rotary lever having a first arm 6 which serves to release and pivot the sheet decurler 1 inwardly into the gap 3, and having a second arm 7 which serves to displace the surface element 4. To achieve the movement or displacement of the surface element 4, a roller 24 is also disposed on the second arm 7, this roller 24 cooperating with a slot or coulisse 26 formed in the cantilever 25 extending from the displaceable surface element 4.

Figure 3:
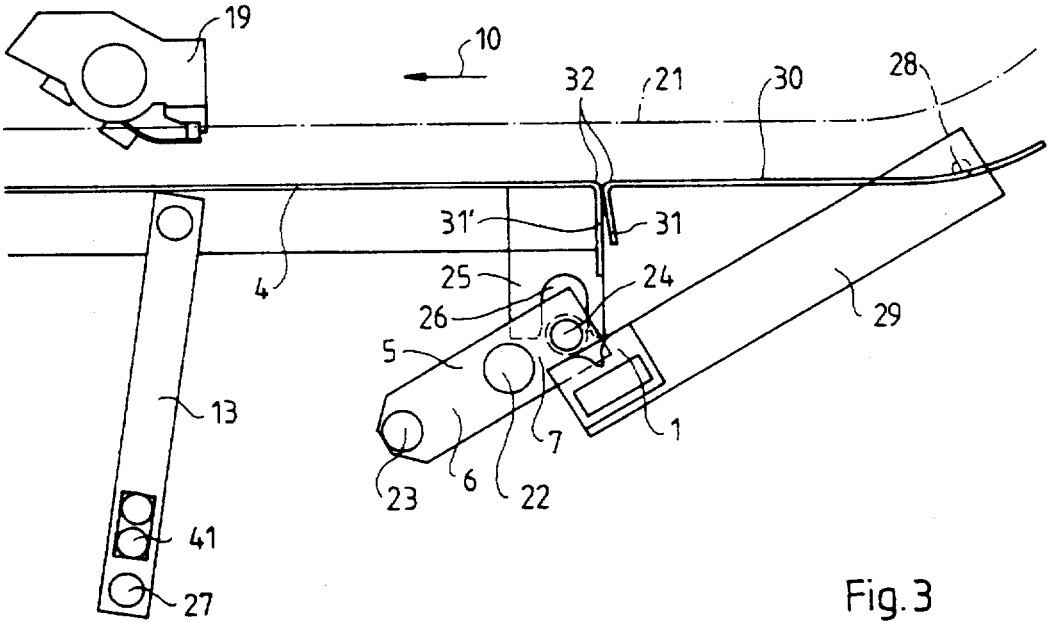
FIG. 3 is a view like that of FIG. 2, wherein the first embodiment is in a recto/verso or two-sided printing position.

FIG. 3 shows the same detail of FIG. 2 in the two-sided printing position. In order to get from the position of FIG. 2 to the position of FIG. 3, the drive lever 5 rotates, in the course of which the first arm 6 having the roller 23 releases the sheet decurler 1, and the sheet decurler pivots downwardly of its own weight or due to a non-illustrated spring about the pivot shaft 28. In FIG. 3, the sheet decurler 1 is shown in a position in which the pivot lever 29 of the sheet decurler 1 is pivoted downwardly. In the course of this rotation of the drive lever 5, the second arm 7 moves upwardly and with the roller 24 thereof engages in the slot 26 formed in the cantilever 25 of the displaceable surface element 4. The surface element 4 is displaced counter to the sheet travel direction 10 in such a way that it strikes the stationary guide surface portion 30 and is retained thereat via the driver lever 5 and the detent 35. Two bent edges 31 and 31' meet one another, and rounded corners 32 assure that no sharp-edged shoulder is formed. In this way, the guide surface 2 is closed, and a sheet printed on both sides thereof can be moved without smearing along the sheet travel path 21 by the grippers 19. To that end, the guide surface 2 may also be provided with air nozzles to create a cushion of air.

Figure 4:
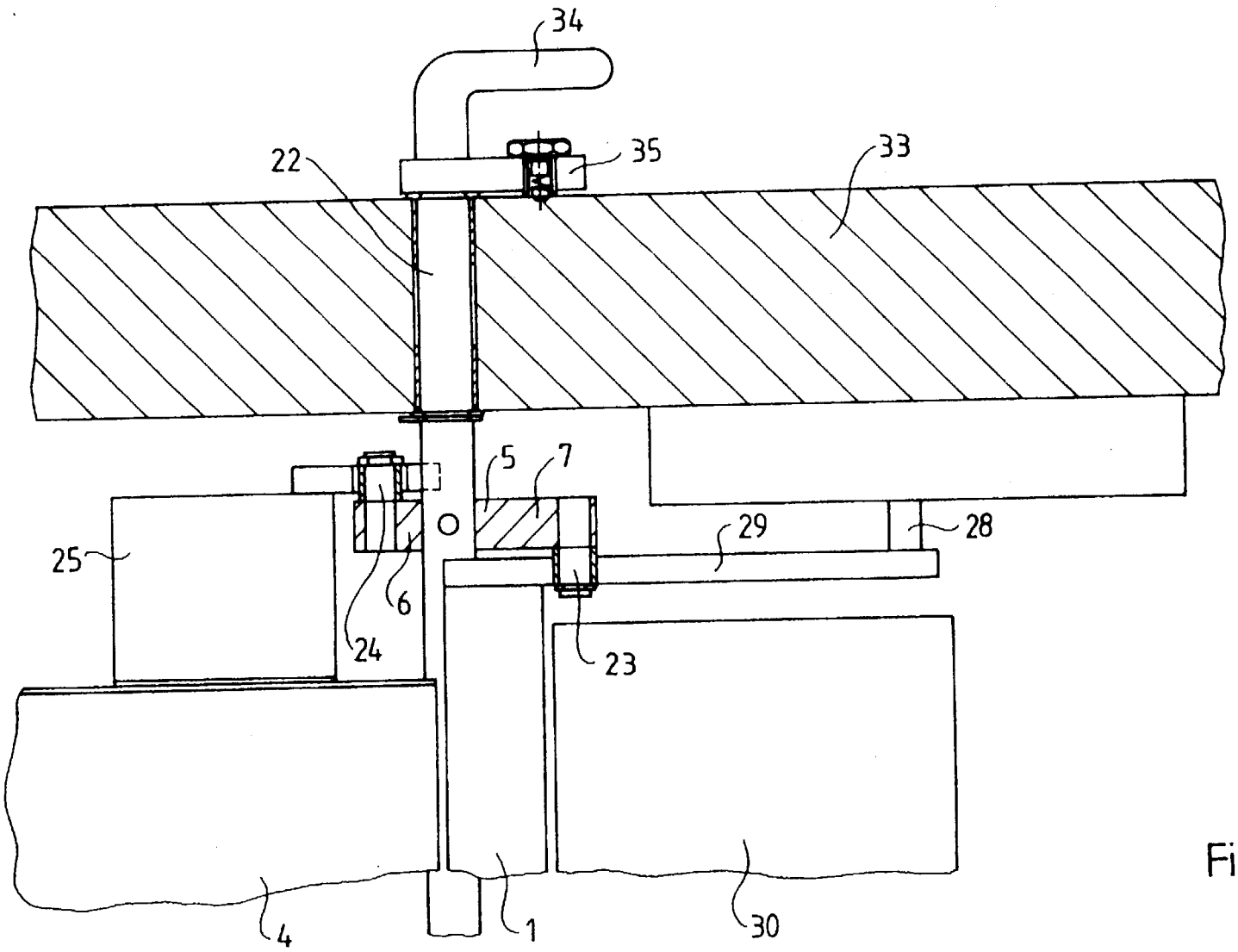
FIG. 4 is an enlarged fragmentary bottom plan view, partly in section and partly broken away, of FIG. 2.

FIG. 4 shows the first exemplary embodiment partly in section, as viewed from below. In this view, one side of the press is shown, and one side wall or frame 33 thereof is shown in section. It is believed to be readily apparent as to how a pivot shaft 22 of the drive lever 5 can be passed through the side wall 33 and actuated from outside by a hand lever 34. A detent 35 assures that the pivot shaft 22 will be kept in the desired position. This detent 35 may be constructed as a spring-loaded ball, for example. The position shown corresponds to a position during the switchover or conversion from the one-sided printing position to the two-sided printing position. The drive lever 5 at this time has already moved out of the vertical position in FIG. 2 but has not yet completely released the sheet decurler 1 and then moves by further rotation into a position for releasing the sheet decurler 1, so that then or with a slight chronological overlap it will engage in the slot 22 formed in the cantilever 25 of the displaceable surface element 4 and displace the surface element 4. In FIG. 4, only one side of the press is shown, but it is expedient to construct the pivot shaft 22 as extending through the press, and for the parts described also to be provided on the other side of the press, so that a uniform course of motion is achieved and so that no torsion of the components will occur. The aforedescribed parts could, however, also be provided on only one side of the press. In that case, it is expedient under some circumstances if a pair of opposed pivotable levers 13 are joined to one another by a crossbar 41, so as to attain a uniform course of motion and prevent torsion.

Figure 5:
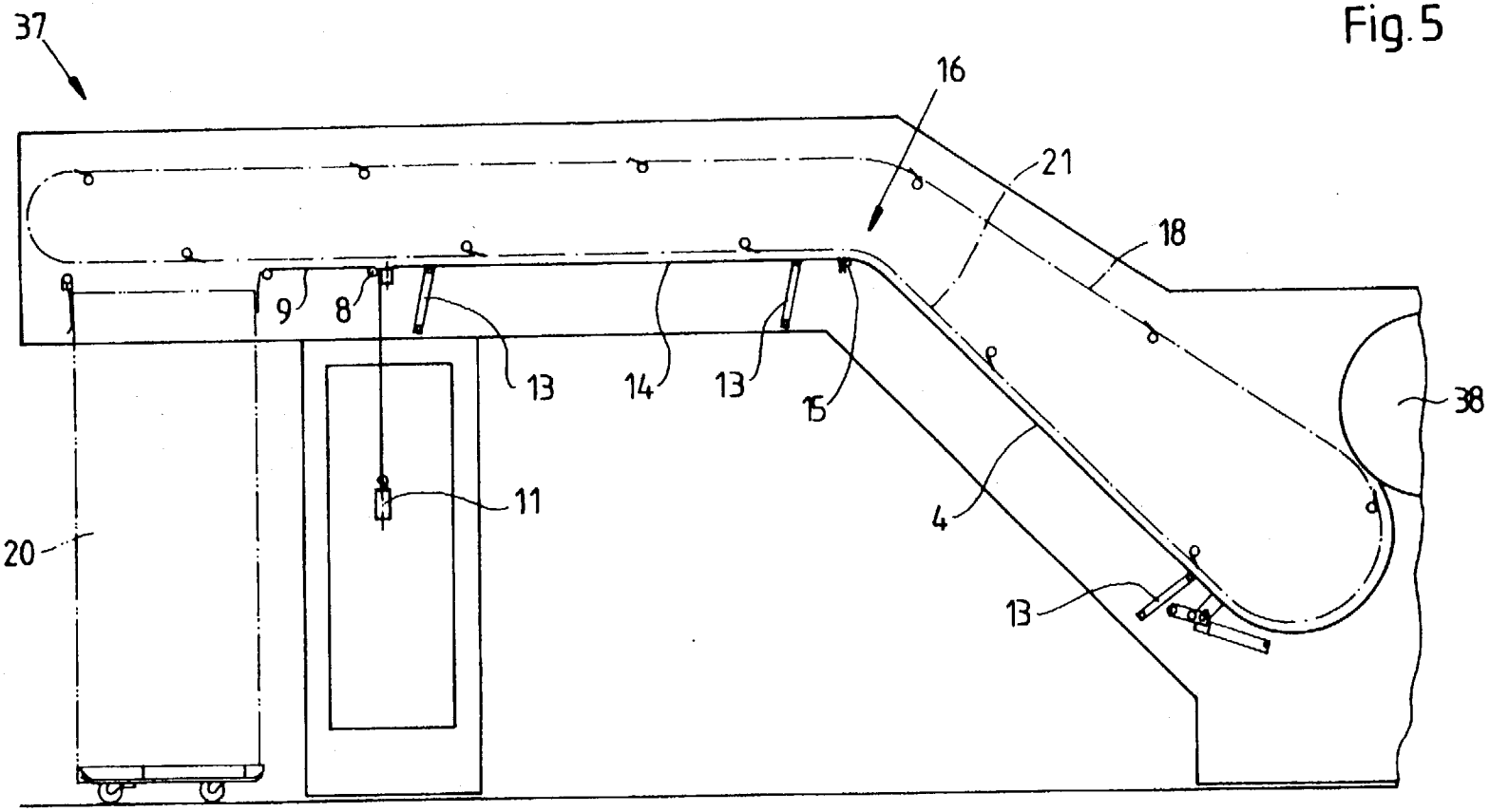
FIG. 5 is a view similar to that of FIG. 1 of a second exemplary embodiment of the sheet guiding device according to the invention, with a change in direction of the sheet travel path in a recto/verso or two-sided printing position.

FIG. 5 shows a second exemplary embodiment with a change of direction 16 of the sheet travel path 21, this change of direction 16 serving to feed the sheets obliquely or inclined upwardly after the last sheet-guiding cylinder or drum 38, and then to change to the horizontal. It is thereby possible to provide a higher delivery pile 20, so that the pile need not be changed so often. In the case of the delivery system 37 with the directional change 16 in the sheet travel path 21, the guide surface 2 must also follow along with this change of direction 16. To that end, it is provided that a further displaceable surface element 14 adjoin the displaceable surface element 4 at the point of the directional change 16 in the sheet travel path 21, this further displaceable surface element having a rotationally movable connection 15 with the displaceable surface element 4. It is also possible to provide only one pair of pivotable levers 13 for the first displaceable surface element 4, because the other end is retained by the rotationally movable connection 15. In contrast therewith, the further displaceable surface element 14 has two pairs of pivotable levers 13. Naturally, both in this exemplary embodiment and the previous one, the pivotable levers 13 may be replaced by guides of some other type.

FIG. 5 shows the sheet guiding device in the two-sided printing position, in which the sheet decurler 1 is pivoted outwardly from the gap 3 and in which, to make a closed guide surface 2, the gap 3 is closed by the displacement of the surface element 4 and of the further displaceable surface element 14. In this exemplary embodiment, as well, a flexible sheet guiding element 9 may be provided, however, in this embodiment the rod 8 adjoins the further displaceable surface element 14. The sheet guiding element 9 extends from the displaceable surface element 14 all the way to the delivery pile 20. Otherwise, the function or operation of this embodiment is the same as that for the embodiment described above.

Figure 6:
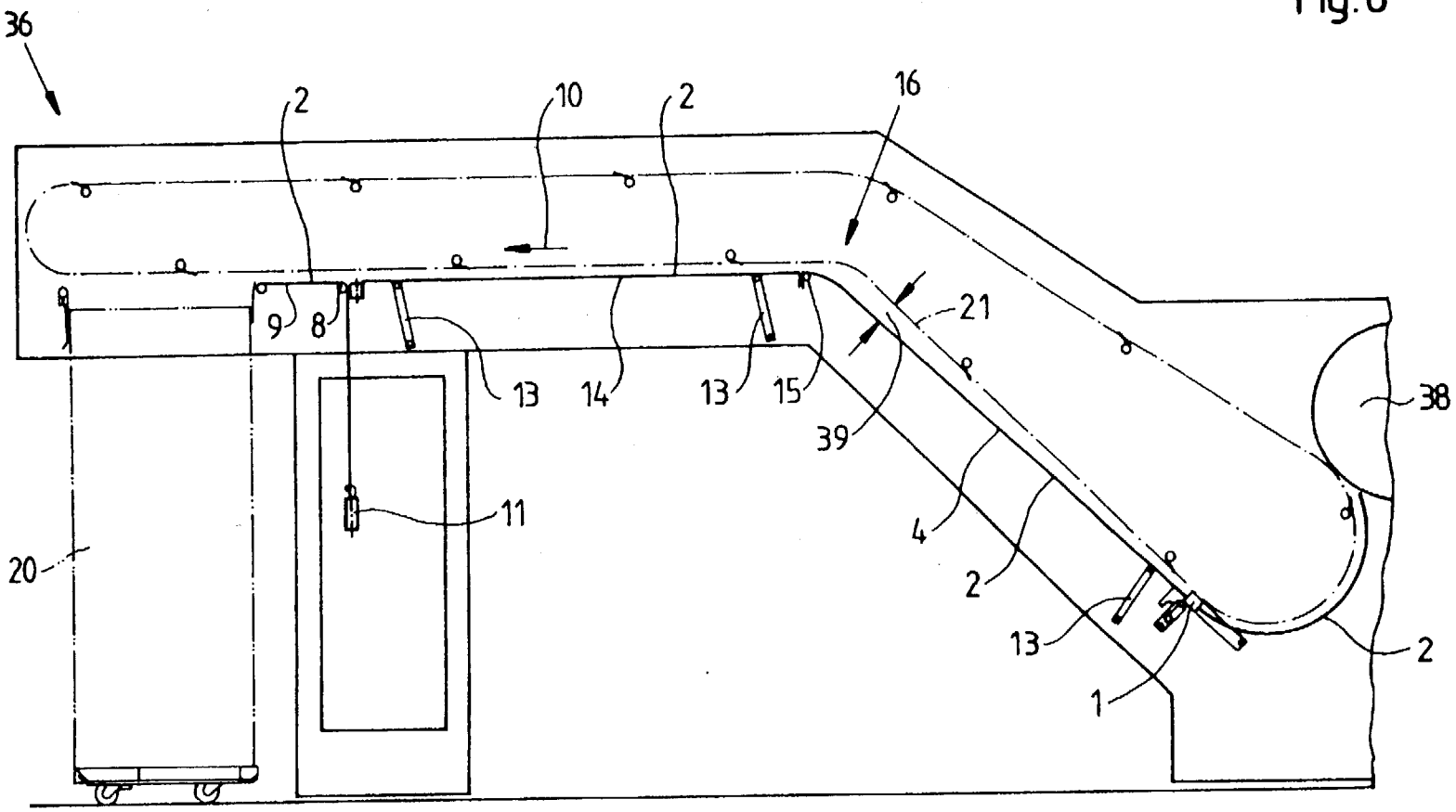
FIG. 6 is a view like that of FIG. 5, wherein the second embodiment is in a recto or one-sided printing position.

FIG. 6 shows the second exemplary embodiment in the one-sided printing position. For pivoting the sheet decurler 1 inwardly into the gap 3, which is performed in the manner described hereinbefore, the displaceable surface element 4 is displaced in the sheet travel direction 10. The surface element 4, via the rotationally movable connection 15, shares the displacement of the further displaceable surface element 14 and, as a result, the entire guide surface 2 goes along with the aforementioned motion. As described above, once again in this embodiment, the flexible sheet guiding element 9 assures that the guide surface 2 will remain closed for as far as the delivery pile 20. In this further feature, however, because of the displacement, some enlargement of the spacing 39 between the guide surface 2 and the sheet travel path 1 occurs. However, this is no problem for one-sided printing, because the underside of the sheet is not printed and smearing cannot occur.

Figure 7:
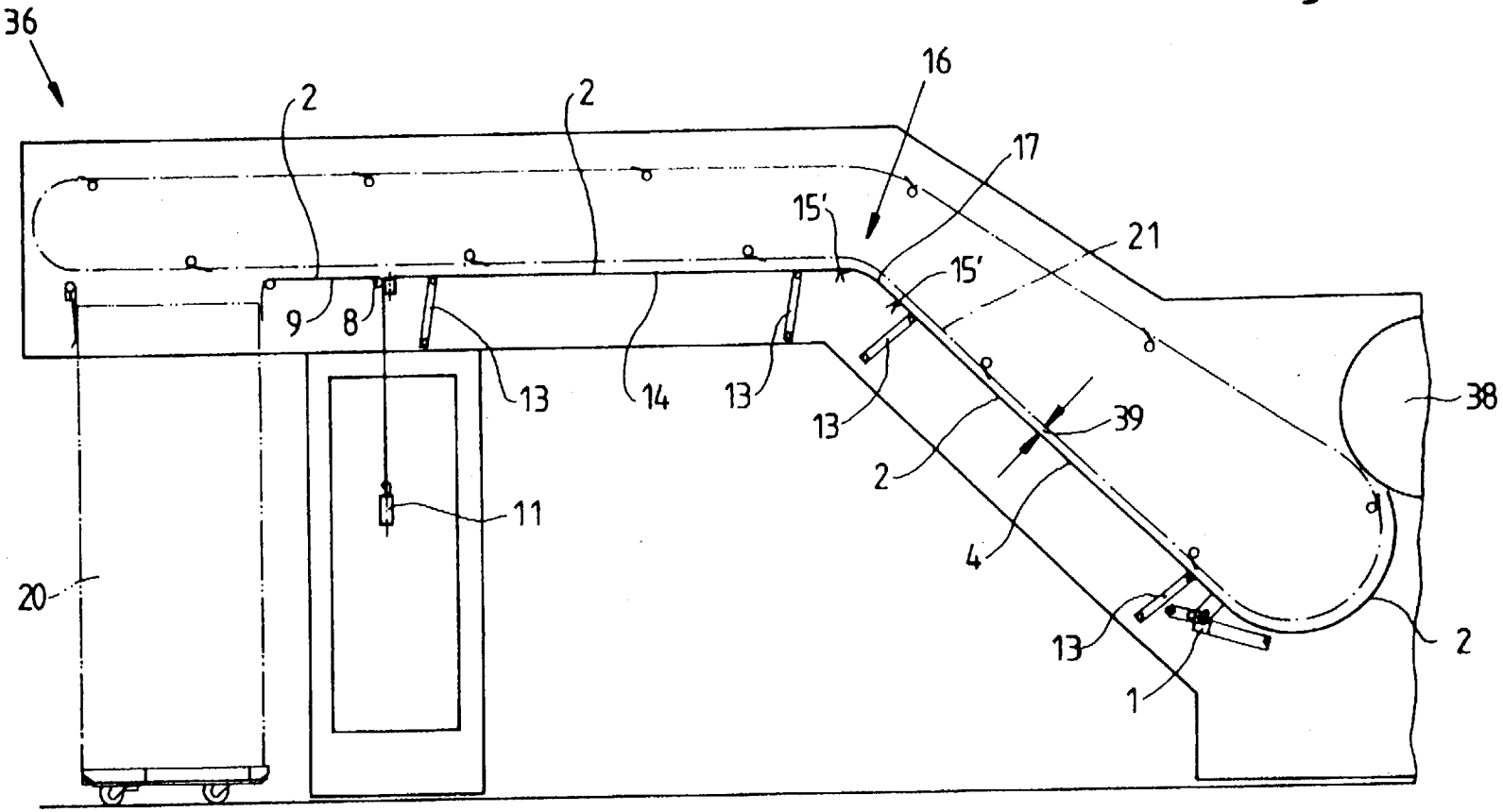
FIG. 7 is a view like that of FIG. 5, of a modified version of the second exemplary embodiment in a recto/verso or two-sided printing position.

FIG. 7 shows a variation in the construction of the second exemplary embodiment in the two-sided printing position. In this variation, a curved intermediate piece 17 is provided between the displaceable surface element 4 and the further displaceable surface element 14 and has rotationally movable connections 15 with each of these parts 4 and 14.

Figure 8:
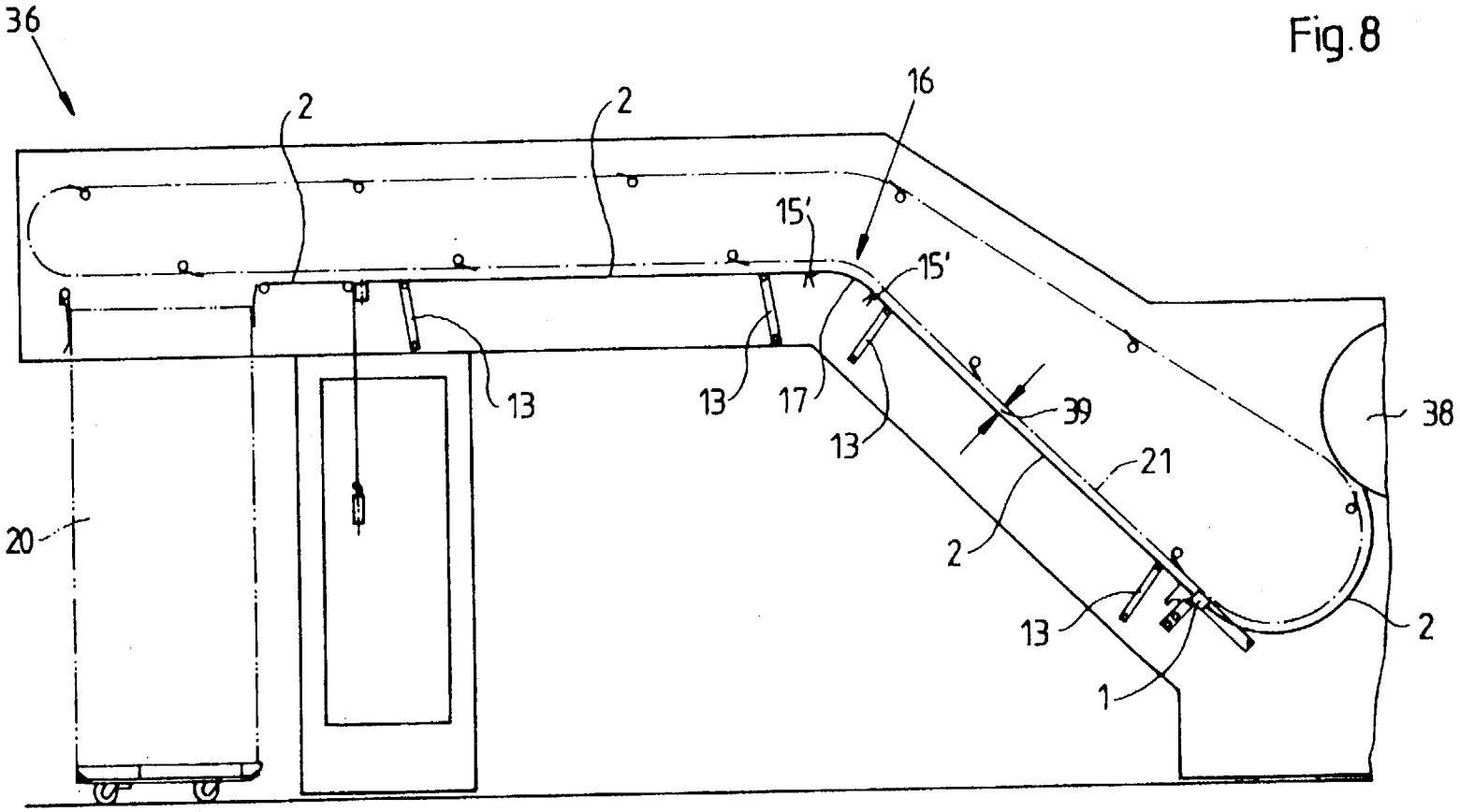
FIG. 8 is a view like that of FIG. 7 showing the modified version of the second embodiment in a recto or one-sided printing position.

FIG. 8 shows the same exemplary embodiment in the one-sided printing position, a comparison of the two positions showing that the spacing 39 between the guide surface 2 and the sheet travel path 21 is not changed by the displacement of the surface elements 4 and 14. This variation serves to ensure that sheet travel will always be exact even in one-sided printing, which is advantageous, for example, whenever the printing on the underside of the sheet is performed by another pass of the sheets through the printing press.

Figure 7A:
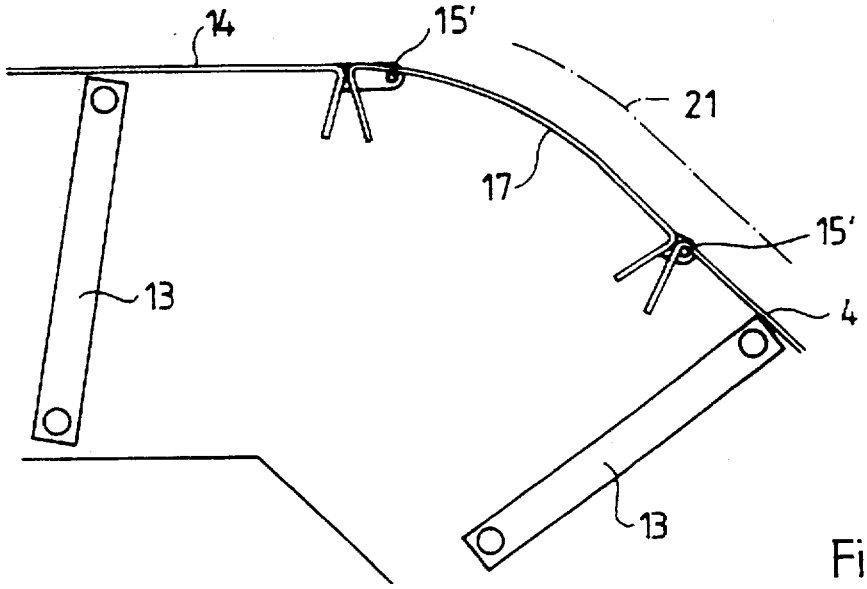
FIG. 7*a* is an enlarged fragmentary view of FIG. 7.
Figure 8A:
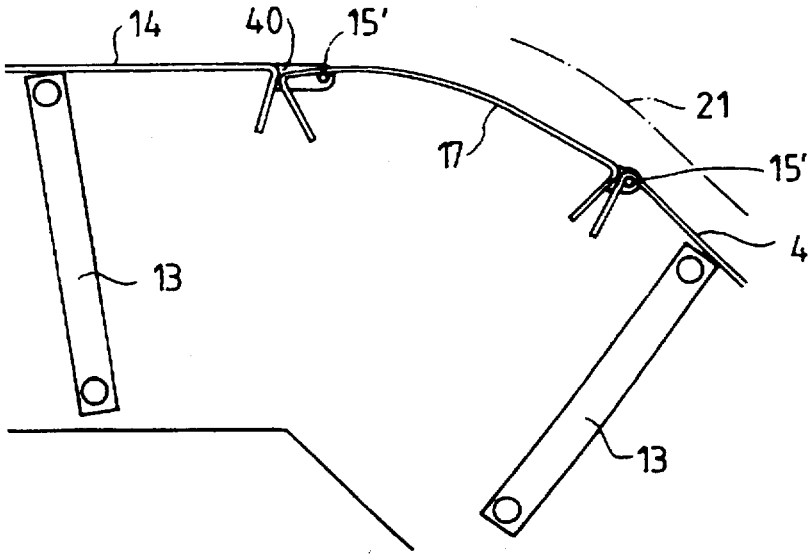
FIG. 8*a* is an enlarged fragmentary view of FIG. 8.

FIGS. 7*a* and 8*a* show enlarged details of FIGS. 7 and 8. It is believed to be readily apparent that, by the adjustment to the one-sided printing position (FIG. 8*a*), an edge 40 appears at the rotationally movable connection 15 between the curved intermediate piece 17 and the further displaceable surface element 14. However, this edge 40 is not a problem in one-sided printing, especially because no gap which would interrupt the cushion of air appears.

In a non-illustrated variation in the construction, wherein the connecting or intermediate piece 17 is flexible, even the edge 40 is avoided.

We claim:

1. A sheet guiding device for printing presses, wherein, for recto printing, a sheet decurler is pivotable into a gap formed in a guide surface and, for recto/verso printing, the sheet decurler is pivotable out of the gap, a surface element of the guide surface being displaceable for closing the gap wherein the sheet decurler is engageable, comprising a drive lever which, for switching to recto printing, is operatable for displacing the surface element in order to form the gap and for engaging the sheet decurler and pivoting it into the gap, said drive lever, for switching to recto/verso printing, being operatable for releasing the sheet decurler to swivel out of the gap and for engaging and displacing the surface element.

2. The sheet guiding device according to claim 1, said drive lever being a two-armed rotary lever having a first arm for releasing and pivoting the sheet decurler into the gap, and a second arm for displacing the surface element.

3. The sheet guiding device according to claim 1, wherein the displaceable surface element is disposed downstream of the gap, as viewed in the sheet travel direction.

4. The sheet guiding device according to claim 3, including a flexible sheet guiding element for extending the guiding surface being disposed between an end of the surface element and a delivery pile, said flexible sheet guide element being secured at one end thereof and, at the other end thereof, being shortenable and elongatable by deflection and force application in accordance with the displacement of the surface element.

5. The sheet guiding device according to claim 3, wherein the surface element, at the end thereof viewed in the sheet travel direction, has a rod disposed crosswise to the sheet travel direction, a flexible sheet guiding element being guidable over said rod, said flexible sheet guiding element being acted upon in the vicinity of said rod by a force directed away from the sheet travel direction, and being retained at the other end thereof so that the sheet guiding element adjoins the surface element and extends the guide surface.

6. The sheet guiding device according to claim 4, wherein said flexible sheet guiding element is a closed web.

7. The sheet guiding device according to claim 4, wherein said flexible sheet guiding element is formed of a plurality of cords.

8. The sheet guiding device according to claim 1, including a guide for supporting the surface element.

9. The sheet guiding device according to claim 1, including pivotable levers for supporting the surface element.

10. The sheet guiding device according to claim 9, wherein said pivotable levers are disposed so that the position of the surface element relative to the sheet travel path is the same in both recto printing and recto/verso printing.

11. The sheet guiding device according to claim 1, wherein the sheet travel path has a change of direction at a given location thereof, and wherein the surface element is connected rotationally movably to a further displaceable surface element following the sheet travel path after said change of direction thereof, said rotationally movable connection being disposed at said location of said change of direction.

12. The sheet guiding device according to claim 11, wherein said rotationally movable connection has a curved intermediate piece connected rotationally movably both to the surface element and to said further displaceable surface element.

13. The sheet guiding device according to claim 11, wherein the surface element is connected to said further displaceable surface element by a flexible connecting piece, said flexible connecting piece being disposed at said location of said change of direction.

* * * * *